US005435623A

United States Patent [19]

Kapec et al.

[11] Patent Number: 5,435,623

[45] Date of Patent: Jul. 25, 1995

[54] INTERACTIVE SEATING DEVICE

[76] Inventors: Jeffrey Kapec, 248 Wilton Rd., Westport, Conn. 06880; Kazuna Tanaka, 5 Frontier Rd., Cos Cob, Conn. 06807; Samuel Montague, 11 Rowayton Woods, Norwalk, Conn. 06854

[21] Appl. No.: 717,508

[22] Filed: Jun. 19, 1991

[51] Int. Cl.[6] ..... A47C 3/30

[52] U.S. Cl. ..... 297/339; 297/344.19; 297/284.11

[58] Field of Search ..... 297/345, 284 H, 312, 297/338, 339, 284.1, 284.11, 344.18, 344.19, 337

[56] References Cited

U.S. PATENT DOCUMENTS

| | | | |
|---|---|---|---|
| 3,446,532 | 5/1969 | Cramer | 297/312 |
| 3,964,725 | 6/1976 | Matsui et al. | 297/348 X |
| 4,854,641 | 8/1989 | Reineman et al. | 297/345 |
| 4,966,413 | 10/1990 | Palarski | 297/312 X |

FOREIGN PATENT DOCUMENTS

| | | | |
|---|---|---|---|
| 2519861 | 7/1983 | France | 297/DIG. 10 |
| 3018323 | 12/1981 | Germany | 297/312 |
| 2205737 | 12/1988 | United Kingdom | 297/345 |
| 8906101 | 7/1989 | WIPO | 297/345 |

*Primary Examiner*—Kenneth J. Dorner
*Assistant Examiner*—Milton Nelson, Jr.
*Attorney, Agent, or Firm*—Michael Ebert

[57] ABSTRACT

An interactive seating device such as a stool or chair which makes it possible for an individual to sit down without having to lower himself to do so, the seated individual being thereafter assisted in getting up from the seat. The device includes an articulated seat whose front segment is hinged to a rear segment and is so linked thereto that in a perching mode in which the rear segment is at an elevated level and the front segment is folded down, an individual can then perch on the rear segment without having to lower himself. The rear segment is mounted on a depressible spring mechanism supported on a stand that normally raises the seat to the perching mode level. When the individual perches on the rear segment, the resultant load imposed thereon depresses and thereby energizes the spring mechanism, causing the seat to sink to a sitting mode level at which the front segment is outstretched to fully support the seated individual. And when the individual thereafter seeks to get up from the seat, he is assisted in doing so by the energized spring which then urges the seat to return to the perching mode level.

9 Claims, 2 Drawing Sheets

10
10A
11
11A
13
14
15
16
17
18
18A
19
20
21
22
23
24
25
26

INTERACTIVE SEATING DEVICE

BACKGROUND OF INVENTION

1. Field of Invention

This invention relates generally to stools, chairs and other types of seating devices adapted to seat an individual, and more particularly to an interactive seating device which makes it possible for an individual to take a seat without having to lower himself to do so, and which thereafter assists the seated individual in getting up from the seat.

2. Status of Prior Art

Ergonomics or human factors engineering deals with the interaction between a manufactured device and an individual making use thereof, the engineering taking into account the capabilities and limitations of the user. Thus a device which is efficient from the standpoint of human factors engineering is said to be "user-friendly." This applied science comes into play in the design of control handles, cockpits, chairs and other devices which unless properly interfaced to the size, strength and shape of the human user, will not effectively carry out its intended purpose.

Designers of stools, chairs and other seating devices usually seek to factor into the design the capabilities and limitations of typical individuals who will make use of these devices. However, in this context, the term typical is misleading, for it fails to factor in a substantial percentage of potential users. In the modern age, the life expectancy of the average individual runs into the seventh decade, women generally having a life span a few years longer than men. As a consequence, a significant percentage of the population is composed of so-called senior citizens or retirees, a fair number of whom are relatively enfeebled or otherwise handicapped as compared to those who are middle aged or youthful.

It is for this reason that a chair or other seating device, which from a human factors engineering standpoint may be regarded as well designed, is only so with respect to users who are in reasonably good physical condition. The same seating device may be hazardous to an elderly or enfeebled individual.

The conventional, well-designed chair has a seat which comfortably accommodates the posterior of the individual and his thighs or hind limbs This seat is at an elevation relative to the floor, such that when the individual is seated, his legs are then more or less vertical and his feet rest on the floor. Because the level of the seat is well below that of the posterior of an erect individual, in order to sit down, the individual must lower himself to the level of the seat.

The act of crouching in order to be seated presents no problem to a person in reasonably good physical condition. Nor is it difficult for that individual, when seated, to get up from the seat, even though in doing so he must lift his weight. But these routine movements which a person in good condition carries out almost without thinking, may represent an obstacle course to an elderly, enfeebled or handicapped person.

If this person finds it too difficult to crouch in order to lower himself into a seat, he may instead find it easier to let go and just fall into the seat. But this free fall may result in a hair line fracture or other injury, particularly if the seat is uncushioned. Even more difficult is for this person, once he has succeeded in sitting down, is to later get up from the seat, for this lifting action may take more strength than he or she possesses.

SUMMARY OF INVENTION

In view of the foregoing, the main object of this invention is to provide an interactive seating device which makes it possible for the user thereof to sit down without having to lower himself to do so, and which when the seated user tries to get up from the seat, then assists him in doing so.

A significant advantage of the invention is that it does not interfere with the user's normal body movements, for in order to sit down, the user simply perches on the seat which initially is at an elevated level and which then proceeds to sink to a normal sitting level and to carry the individual to this level. And in getting up from the seat, as the user lifts himself to do so, the seat is then urged upwardly to assist the user in this action.

Also an object of this invention is to provide an interactive seating device which may be mass produced at relatively low cost and which operates efficiently and reliably.

Briefly stated, these objects are accomplished in an interactive seating device such as a stool or chair which makes it possible for an individual to sit down without having to lower himself to do so, the seated individual being thereafter assisted in getting up from the seat. The device includes an articulated seat whose front segment is hinged to a rear segment and is so linked thereto that in a perching mode in which the rear segment is at an elevated level and the front segment is folded down, an individual can then perch on the rear segment without having to lower himself.

The rear segment is mounted on a depressible spring mechanism supported on a stand that normally raises the seat to the perching mode level. When the individual perches on the rear segment, the resultant load imposed thereon depresses and thereby energizes the spring mechanism, causing the seat to sink to a sitting mode level at which the front segment is outstretched to fully support the seated individual. And when the individual thereafter seeks to get up from the seat, he is assisted in doing so by the energized spring which when urges the pan to return to the perching mode level.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Interactive Stool

Figures 1, 2, 3:
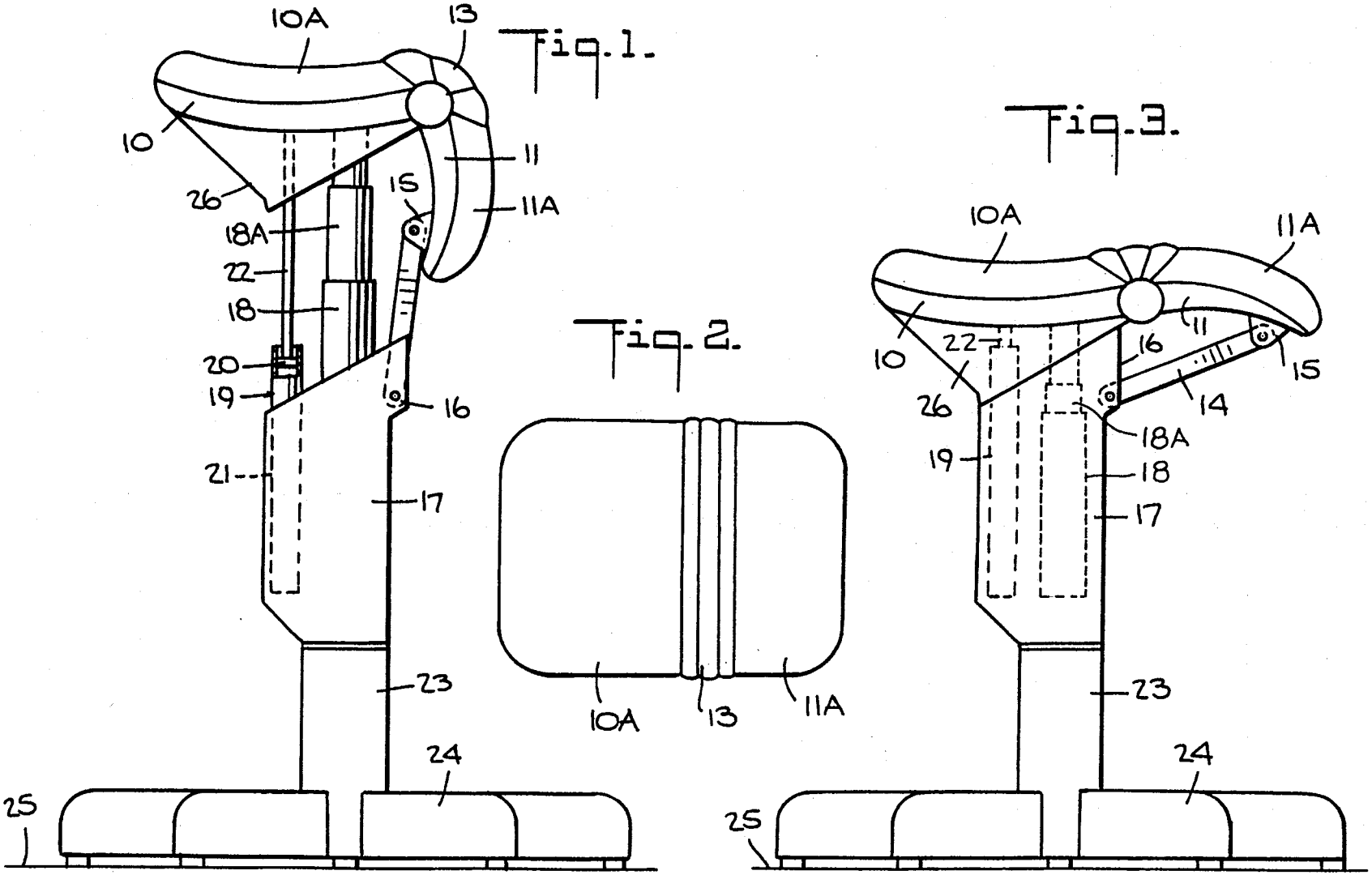
FIG. 1 shows in elevation an interactive stool in accordance with the invention, the stool being illustrated in its perching mode.
FIG. 2 shows the stool in its sitting mode.
FIG. 3 is a top view of the seat in its unfolded state.

Referring now to FIG. 1, an interactive stool in accordance with the invention is shown in the form it assumes when the stool is in its perching mode. In this mode, the level of the seat is such that it is close to that of the posterior of a typical erect individual, so that this individual can place his posterior on the seat without having to raise or lower himself to a substantial degree to do so.

The stool includes an articulated seat pan constituted by a rear segment 10 and a front segment 11 pivoted thereon by a suitable hinge mechanism 12. Rear segment 10 is upholstered by a cushioning pad 10A, while front segment 11 is upholstered by a cushioning pad 11A. Upholstering is optional, for in practice the articulated seat pan may be formed of rigid molded plastic material without upholstering.

In the perching mode of the stool, front segment 11 is folded down so that the user may without difficulty place his posterior on the rear segment 10. FIG. 3 illustrates the sitting mode of the stool. The sitting mode is assumed when the seat whose rear segment is loaded by the posterior of the user and the seat then sinks from the perching mode level to a lower seating level, in the course of which action the front segment 11 folds out and is then outstretched to support the thighs of the seated individual.

To conceal the hinge mechanism and provide continuity between the front and rear segments of the seat, the junction between the upholstery pads 10A and 11A is provided with an expandable cover 13 of flexible plastic, leather or other suitable material in a bellows-like or accordion formation. When front segment 11 is folded down, as shown in FIG. 1, the cover 13 is expanded, and when it is folded out, as shown in FIG. 3, the cover is contracted.

Front segment 11 of the seat pan is operatively linked to rear segment 10 by means including a lever arm 14, one end of which is pivotally connected to a bracket 15 on the underside of front segment 11 adjacent its leading edge. The other end of lever arm 14 is pivotally connected to a front extension 16 on the inclined upper end of a casing 17. Vertically supported within casing 17 is an extensible post 18 formed by telescoping metal tubes of progressively reduced diameter, the upper tube 18A being joined to the underside of rear segment 10. Thus when the seat pan is raised, the post 18 is extended, and when the pan is lowered, the post is collapsed.

Also vertically mounted within casing 17 is a pneumatic spring mechanism 19 having a piston 20 which is slidable within a barrel 21 having compressible gas entrapped therein. Piston 20 is attached to one end of a piston rod 22 whose other end is secured to the underside of rear segment 10. When, therefore, a load is imposed on rear segment 10 by an individual who perches on this segment, this load acts to depress and energize the spring mechanism.

That is to say, piston 20 is then pushed downwardly into the barrel by rod 22, this downward movement resulting in compression of the air trapped in barrel 21. When the load is thereafter removed from the rear segment, the compressed air then seeks to expand, and as it expands it forces piston 20 to its uppermost position in the barrel, thereby returning rear segment 10 to its elevated perching mode level.

Casing 17 which houses spring mechanism 19 and telescoping post 18 is mounted on top of a vertical stand 23 supported on a multi-legged base 24 resting on the floor 25. The combined length of the stand and of casing 17 mounted thereon are such as to elevate the seat pan so that it is initially at the perching mode level.

In the perching mode, front segment 11 is folded down, and rear segment 10, which is always horizontal, is then at an elevated level close to that of the posterior of an average erect individual, so that this individual can perch his posterior on the rear segment without having to lower himself to do so. When this happens the load then imposed on the rear segment acts to shorten the telescoping post 18 and at the same time depress the pneumatic spring mechanism 19 and thereby engage the spring.

Attached to the underside of rear segment 10 is a shroud 26 having an inclined bottom end which complements the inclined upper end of casing 17. When, therefore, the seat is caused to sink by the weight of the individual perching thereon, the seat gradually lowers itself against the resistance offered by the pneumatic spring mechanism 19 which is then undergoing depression until, as shown in FIG. 3, the inclined bottom end of shroud 26 abuts the complementary inclined upper end of casing 17 which then acts as a stop.

As the seat proceeds to sink from the perching mode level FIG. 1) to the sitting mode level (FIG. 3), lever arm 14 interconnecting front seat pan segment 11 and the upper end of casing 17 which at the perching mode level is almost vertical, then proceeds to swing out, this action causing the front seat segment 11 to fold out to assume the outstretched position shown in FIG. 3.

When, therefore, an individual who places his posterior on the rear segment 10 when the seat is at the perching mode level is then lowered by the seat to the sitting mode level, the outstretching of the front segment 11 at this level serves to engage the thighs of the seated individual and thereby fully and comfortably support him at the seating level.

When the seated individual in the sitting mode of the stool wishes to get out of the seat, he must then lift himself up to an erect position, and he may lack the strength to carry out this action without assistance. However, because spring mechanism 19 is depressed when the seat goes from the perching to the sitting mode level, it is energized by this movement. This latent energy is released when the individual rises from the seat and acts to urge the seat toward the perching mode level, and in doing so assists the individual in getting up from the seat.

The transition between the two modes is gradual and smooth by reason of the pneumatic spring mechanism which resists a rapid or abrupt drop in elevation in going from the perching mode to the sitting mode. In going from the sitting mode to the perching mode, until such time as the load imposed on the seat by the individual is entirely removed therefrom, the seat under the urging of the spring mechanism will rise gradually. As soon as the seated individual begins to move forward to rise out of the seat, he will feel the spring-urged lift of the seat pan.

The seating device does not interfere with a person's normal body movement when shifting from a standing and sitting position. In practice, the pneumatic spring mechanism may be provided with adjustment means so that it can be accommodated for different body weights to lower the seat at a desired rate.

Fold-Seat Lounger

Figure 5:
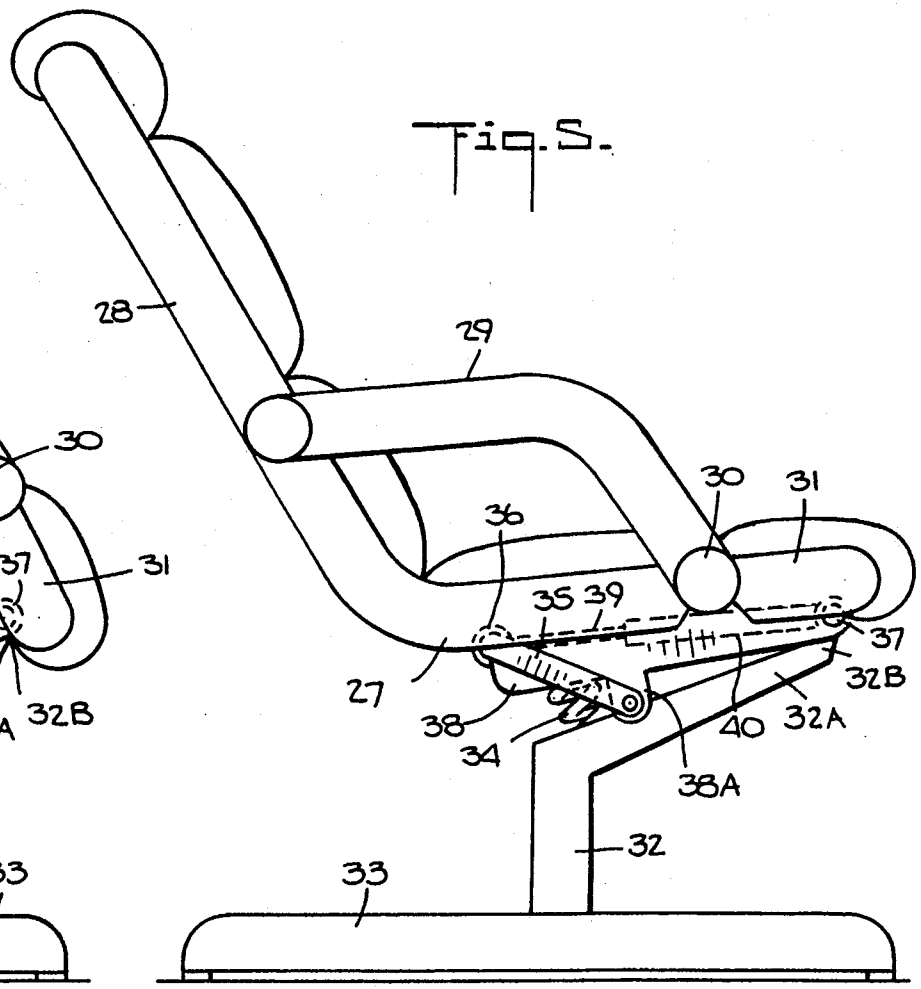
FIG. 5 shows the chair in its sitting mode.
Figure 4:
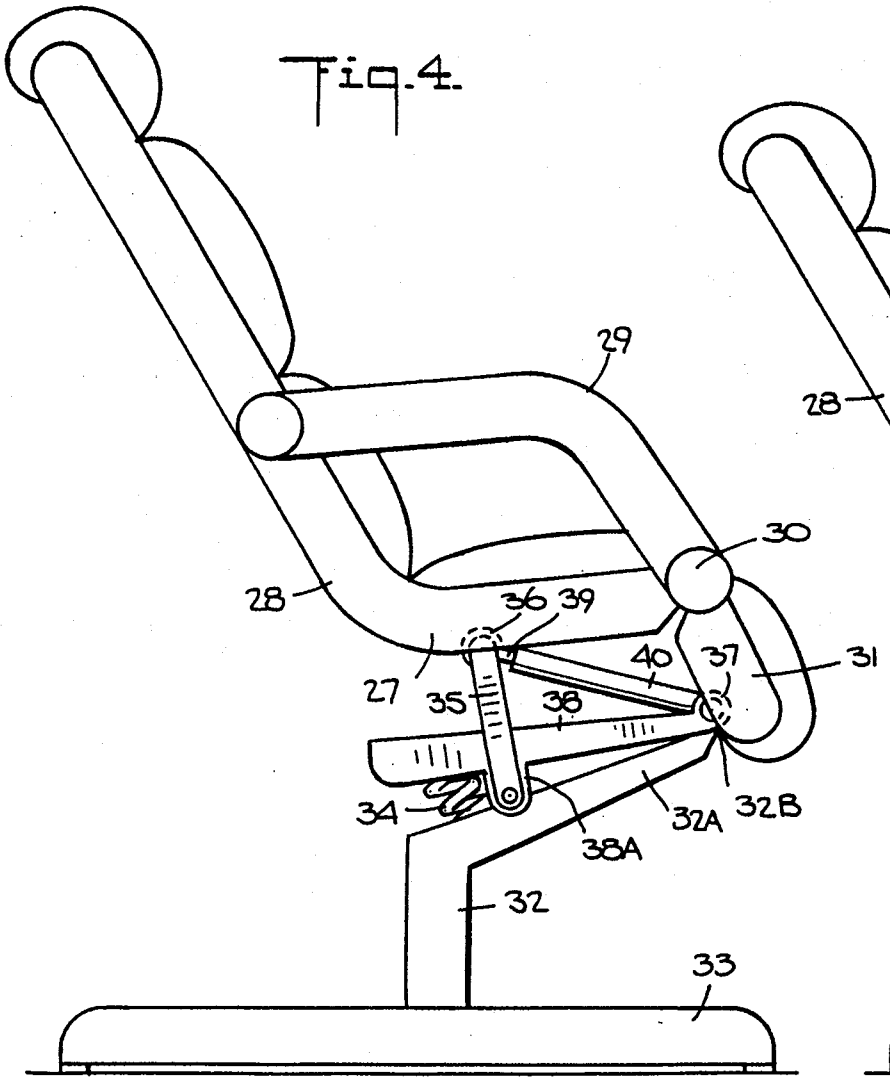
FIG. 4 illustrates in elevation a lounger-type chair in accordance with the invention in its perching mode.

In the interactive lounger-type chair shown in FIGS. 4 and 5, the chair includes a rear segment 27 that merges with a back rest 28 so that the occupant of the seat has his back supported. Also provided are side arms 29.

Pivoted on the front edge of rear seat segment 27 by a hinge mechanism 30 is a front seat segment 31, both segments of the seat as well as back rest 28 being upholstered. The seat is mounted on a vertical stand 32 anchored on a stable base 33. Stand 32 is provided with an upper extension 32A which is inclined at an acute angle relative to the vertical stand and terminates in an upwardly-directed arm 32B. Arm 32B is pivotally connected by a hinge mechanism 37 to the underside of front seat segment 31.

In the perching mode of the chair, front seat segment 31 is folded down as shown in FIG. 4. In the sitting mode, as shown in FIG. 5, the front segment is folded out and outstretched to fully support the sitter.

Also linked to hinge mechanism 37 is the front end of a spring-loaded plate 33 which is disposed below the front seat segment 27. A compressible helical spring 34 is connected between the underside of plate 33 adjacent its rear end and the top side of inclined stand extension 32A adjacent the elbow between this extension and vertical stand 32.

Plate 32 is provided adjacent spring 34 with a downwardly-projecting lug 33A. Pivotally connected to this lug is the lower end of a lever 35 whose upper end is pivoted to the underside of rear seat segment 27 by a hinge mechanism 36. Extending between hinge mechanism 36 of the rear seat segment 27 and hinge mechanism 37 on the front seat segment is a pneumatic spring mechanism whose piston rod 39 is connected to hinge mechanism 36 and whose barrel 40 is joined to hinge mechanism 37.

When no one is seated in the chair, compression spring 34 is unloaded and fully extended, as shown in FIG. 4, while lever 35 which extends between plate 33 and the underside of rear segment 27 is then almost vertical. As a result, rear seat segment 27 is elevated above plate 33, this being the elevated perching mode of the chair. In this mode, front seat segment 31 which is pivotally jointed to the front end of plate 33 is folded down and the pneumatic spring mechanism 38 is then compressed and therefore energized.

The elevation of the lounger chair seat in the perching mode is such that a typical individual can place his position in rear segment 27 without having to lower himself to any significant degree to do so, for in this mode the seat is much higher than that of a conventional seat.

However, when this individual places his posterior on the rear seat segment 27, the resultant load imposed thereon causes the rear seat segment to swing on lever 35, as shown in FIG. 5, to cause the underside of rear segment 27 to then rest on plate 33. This action is assisted by the energized pneumatic spring mechanism 38 whose piston rod 39 then advances out of barrel 40.

When rear seat segment 27 swings down on lever 35 to engage plate 33, in doing so it causes front seat segment 31 to fold out, as shown in FIG. 5, thereby fully supporting the seated individual at the lowered level of the seat in its sitting mode. In the sitting mode, spring 34 is depressed by the weight of the seated individual and thereby energized. When, therefore, the seated individual thereafter seeks to arise from the seat, he is assisted in doing so by the spring 34 which then seeks to return the seat to its perching mode level.

Applications

The interactive stool disclosed herein may be used for a variety of end use application in which an individual using the stool needs assistance in transition where otherwise the individual may have difficulty in making this movement on his own accord. Thus many individuals who are able-bodied in most respects suffer from arthritis, a degenerative hip or have a painful lower back problem and therefore require assistance when using a chair or stool. In other instances, a user may be able-bodied in all respects, yet find it necessary to move up and down frequently in the course of a work day. This is true, for example of counter attendants, toll collectors, flight controllers, office workers and tool machine operators.

An interactive seating device in accordance with the invention which assists the individual in sitting down and in getting up serves to reduce fatigue when such actions must be carried out frequently during a working day.

In some instances, it may be desirable to include locking means in the interactive seating device, to lock it in its perching mode and also in its sitting mode. By such means, when the seating device is to be used for a prolonged period in its perching mode, the device can be locked to maintain this mode so that the seating pan will not sink. And if the device is to be used for a prolonged period in its sitting mode, it can be locked to maintain this state, even if the sitter has occasion to get up for a brief period.

Thus an interactive seating device in accordance with the invention, while it has particular advantages for those who are advanced in years or physically impaired, is also advantageous when the users are relatively young and able-bodied but whose occupations are such as to require that they have a need to sit down and get up from a chair at frequent intervals.

In practice, the articulated front segment of the seat which folds out in the sitting mode can be provided with an articulated extension so that the chair then functions as a lounge chair.

While there have been shown and described preferred embodiments of an interactive seating device in accordance with the invention, it will be appreciated that many changes and modifications may be made therein without, however, departing from the essential spirit thereof.

We claim:

1. An interactive seating device which permits an individual to sit down without having to lower himself to a significant degree to do so, and to thereafter assist him in getting up from the seat, comprising:

(a) an articulated seat having a front segment hinged to a rear segment and so linked thereto by linkage means actuable by a depressible spring mechanism whereby in a perching mode of the device in which the rear segment is at an elevated perching level, the front segment is then folded down to occupy a substantially vertical position to permit an individual to perch on the rear segment without interference from the front segment, and in a sitting mode in which the rear segment is at a lowered sitting level, the front segment is folded out and outstretched to fully support the seated individual; and (b) said depressible spring mechanism being operatively coupled to said linkage means, said mechanism underlying the rear segment of the seat and supported on a stand and normally raises the seat to its perching mode level, and in doing so causes the front segment to fold down to permit the individual to perch on the rear segment, whereby when the individual perches on the rear segment, the resultant load depresses and thereby energizes the spring mechanism, causing the seat to sink to a sitting mode level, and in doing so causes the front segment to fold out to fully support the seated individual, and when the individual thereafter seeks to arise from the seat, he is assisted in doing so by the energized spring mechanism which then urges the seat to return to the perching mode level.

2. A seating device as set forth in claim 1, wherein said device is a lounger chair having a back rest joined to the rear segment of the seat.

3. A seating device as set forth in claim 2, wherein said stand is vertical and is provided with an upper extension that is inclined relative to the stand and terminates in an upwardly-projecting arm that is connected by a hinge mechanism to the underside of the front segment of the seat, further including a plate which is disposed below the rear segment, the front end of the plate being linked to the hinge mechanism, said plate being provided at its underside with a downwardly projecting lug which is pivotally connected to one end of a lever, whose other end is pivotally connected to the underside of the rear segment, and a helical spring connected between the underside of the plate and the stand extension, whereby when the rear segment is loaded to depress the spring, the lever is caused to swing and the front segment is then unfolded.

4. A seating device as set forth in claim 1, wherein said device is a stool and said seat is an articulated pan.

5. A seating device as set forth in claim 4, wherein said rear and front segments of the articulated pan are upholstered.

6. A seating device as set forth in claim 5, further including a hinge mechanism intercoupling the front segment of the pan to the rear segment thereof, and a compressible bellows-like cover overlying the hinge mechanism and joined to the upholstery on the front and rear segments to provide continuity therebetween.

7. A seating device as set forth in claim 4, wherein said stand is provided at its upper end with a casing, and said spring mechanism is a pneumatic mechanism having a barrel vertically mounted with said casing and a piston movable in said barrel to compress air entrapped therein, said piston being provided with a piston rod joined to the underside of said rear segment.

8. A seating device as set forth in claim 7, further including a telescoping post vertically mounted in said casing and joined to the underside of the rear segment, whereby the post is extended in the perching mode and collapsed in the sitting mode.

9. A seating device as set forth in claim 7, wherein the upper end of said casing is inclined and said rear segment is provided at its underside with a shroud having an inclined lower end which complements the inclined upper end of the casing and abuts the upper end when the device is in the sitting mode.

* * * * *